United States Patent [19]

Houle et al.

[11] Patent Number: 4,773,977

[45] Date of Patent: Sep. 27, 1988

[54] ANODE MOUNTING CONSTRUCTION FOR A WATER HEATER

[75] Inventors: Timothy H. Houle, Wauwatosa; John D. Pfeffer, Brookfield, both of Wis.

[73] Assignee: A. O. Smith Corporation, Milwaukee, Wis.

[21] Appl. No.: 38,930

[22] Filed: Apr. 16, 1987

[51] Int. Cl.[4] ..... C23F 13/00

[52] U.S. Cl. ..... 204/197; 204/297 R; 204/147; 204/148; 204/196

[58] Field of Search ..... 204/197, 147, 148, 297 R, 204/196; 174/153 R

[56] References Cited

U.S. PATENT DOCUMENTS

| | | | |
|---|---|---|---|
| 2,568,594 | 9/1951 | Robinson | 204/197 |
| 3,138,549 | 6/1964 | Adair | 204/197 |
| 3,388,212 | 6/1968 | Nichols et al. | 174/153 R |
| 3,497,444 | 2/1970 | Paiton | 204/297 R |
| 3,542,663 | 11/1970 | Alewitz | 204/197 |
| 3,718,571 | 2/1973 | Bidwell | 204/197 |
| 3,718,573 | 2/1973 | Bidwell | 204/297 R |
| 3,753,888 | 8/1973 | Alewitz | 204/197 |
| 3,867,274 | 2/1975 | Herman | 204/197 |
| 3,891,530 | 6/1975 | Alewitz | 204/197 |
| 3,953,311 | 4/1976 | Wasson | 204/197 |
| 4,039,417 | 8/1977 | Sasaki et al. | 204/297 R |
| 4,060,472 | 11/1977 | Mewitz | 204/197 |
| 4,093,529 | 6/1978 | Strobach | 204/197 |
| 4,224,126 | 9/1980 | Bidwell | 204/197 |
| 4,420,382 | 12/1983 | Riedl | 204/147 |

*Primary Examiner*—John F. Niebling
*Assistant Examiner*—Steven P. Marquis
*Attorney, Agent, or Firm*—Andrus, Sceales, Starke & Sawall

[57] ABSTRACT

An improved anode mounting construction for a water heater. The inner surface of a steel water heater tank is coated with a corrosion resistent material, such as glass, and the tank is provided with an opening which receives an anode rod. The outer end of the anode is secured to a metal cap and the cap is carried by a steel spud which is welded to the outer surface of the tank bordering the opening. The internal diameter of the spud is greater than the diameter of the opening in the tank and a resislent sealing member or gasket is employed to seal the gap between the anode and the annular edge of the tank ordering the opening. The sealing member seals and protects the annular edge against corrosion, as well as protecting the spud, thereby eliminating accelerated consumption of the outer end of the anode adjacent the tank.

12 Claims, 1 Drawing Sheet

ANODE MOUNTING CONSTRUCTION FOR A WATER HEATER

BACKGROUND OF THE INVENTION

To protect a steel water heater tank against corrosion it is common to coat the internal surface of the tank with a corrosion resistent coating, such as glass. Although coatings of this type are very effective in protecting the steel tank, intensified corrosion can occur in areas of the tank that are exposed through defects in the glass coating or in areas that are inadequately coated with glass, such as where fittings are connected to the tank. To overcome this problem, sacrificial anode rods are normally mounted within the tank and the anode is composed of a metal, such as magnesium, aluminum or zinc, having a higher electrical potential than the steel tank, with the result that the anode will be preferentially dissipated to protect the steel water heater tank.

In the conventional cathodic protection system, the anode is normally formed with a steel supporting core wire and the upper end of the core wire is connected to a steel cap which in turn is threaded within the internal threaded opening of a steel spud that is welded to the outer surface of the tank head. With this construction, the anode will be suspended from the spud and extends downwardly through an opening in the tank head. In order to provide proper alignment of the anode, the internal threaded opening in the spud has a smaller diameter than the opening in the tank head with the result that there is a space between the anode and the edge of the head bordering the opening.

In the normal production procedure, the anode is assembled to the tank after the tank has been glass coated and fired. During the glass coating operation, it is often difficult to adequately glass coat the edge of the upper head tank that borders the anode opening, and similarly it is difficult to adequately coat the inner edge of the spud which is exposed through the opening. Therefore, during operation of the water heater there may be concentrated consumption of the upper end of the anode adjacent these exposed steel areas. This results in a condition called "necking", in which the upper end of the anode will be necked down or decreased in diameter relative to the remaining portion of the anode. If the "necking" continues, the steel core wire will be exposed at the upper end of the anode which will further increase the consumption of the anode in this area.

In an attempt to overcome the "necking" problem, it is has been proposed to enclose the upper end of the anode in an insulating protective sleeve. However, the use of a protective sleeve has not proven satisfactory because it limits the electrolytic current distribution in the upper end of the tank and thus does not adequately protect exposed areas of steel at the upper head.

SUMMARY OF THE INVENTION

The invention is directed to an improved anode mounting construction for a water heater. In accordance with the invention, the upper end of the anode is supported by a cap which is threaded in an opening in a metal spud that is welded to the outer surface of the tank. The opening in the spud has a greater diameter than the opening in the tank head.

The annular gap between the anode and the edge of the tank bordering the opening is sealed by a resilient sealing member such as a washer or grommet. The lower portion of the sealing member seals the gap between the anode and the edge of the tank bordering the opening, while the upper portion of the sealing member extends laterally beyond the opening along the outer surface of the tank and seals against the spud.

The anode mounting construction of the invention serves to effectively seal all exposed steel areas at the location of the anode mounting to thereby prevent increased consumption of the upper end of the anode and the resulting "necking" of the anode.

The mounting construction is of simple and inexpensive construction and can be readily installed from the outside of the tank as the anode is assembled with the tank.

Other objects and advantages will appear in the course of the following description.

DESCRIPTION OF THE DRAWINGS

The drawings illustrate the best mode presently contemplated of carrying out the invention.

In the drawings

DESCRIPTION OF THE ILLUSTRATED EMBODIMENT

Figure 1:
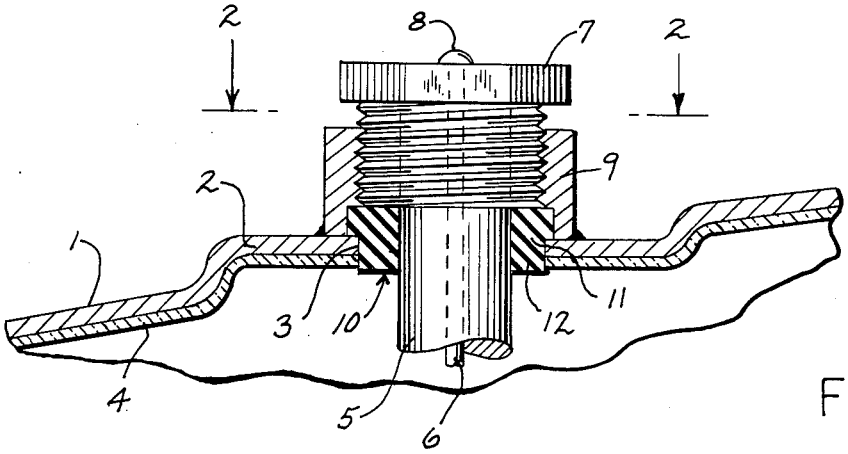
FIG. 1 is a vertical section of the upper end of the water heating tank showing the anode mounting construction of the invention.
Figure 2:
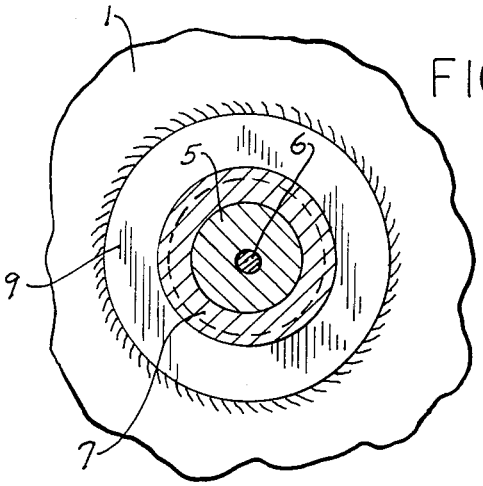
FIG. 2 is a section taken along lines 2—2 of FIG. 1.

FIG. 1 illustrates the upper head 1 of a water heater tank. Head 1 includes a generally a flat area or land 2 which is provided with an opening bordered by annular edge 3. The inner surface of head 1 is provided with a corrosion resistent coating 4 such as glass or porcelain enamel.

The water heater tank including head 1 is normally formed of steel and the coating 4 acts to protect the steel tank against corrosion. In order to protect areas of the steel tank that may be exposed through defects in the glass coating 4 or to protect inadequately coated areas of the tank and fittings, a sacrificial anode 5 is suspended within the tank. The anode is formed of a material which has a higher electrical potential than the steel tank and is generally formed of magnesium, aluminum or zinc or alloys thereof.

The anode 5 is rod-like in shape and is formed with a central supporting steel core wire 6, and the upper end of core wire 6 extends through an opening in a metal cap 7 and is secured to the cap by the enlarged, dome-shaped core end 8. Cap 7 is threaded within an annular steel spud 9 that is welded to the outer surface of head 1 and borders edge 3. As shown in FIG. 1, the internal diameter of spud 9 is greater than the diameter of annular edge 3 in tank head 1.

A resilient gasket 10 made of rubber or plastic material is positioned around the upper end of anode 5 and seals the space between the anode and edge 3 of tank head 1. More particularly, gasket 10 includes an enlarged upper section 11, which extends laterally outward of opening 3 and is disposed between the inner surface of adaptor 8 and tank 1, and a lower section 12 which seals the gap between the anode 5 an annular edge 3. Gasket 10 effectively protects the steel edge 3, as well as the inner annular surface of the steel spud 9.

As all of the exposed steel areas at the location of the anode mounting are affectively sealed by gasket 10, increased consumption of the upper end of the anode and the resulting "necking" of the anode adjacent head 1 is prevented.

Figure 3:
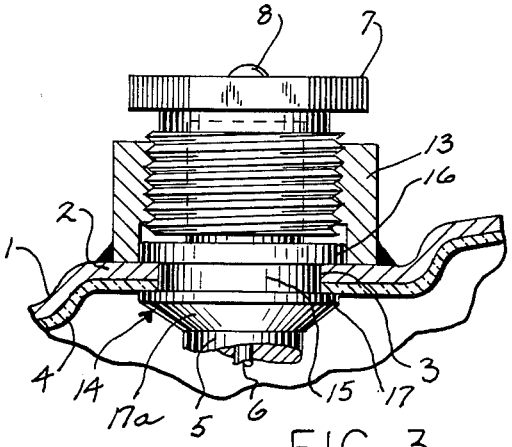
FIG. 3 is a view similar to FIG. 1 showing a modified form of the invention.

FIG. 3 shows a modified form of the invention in which the cap 7 which carries anode rod 5 is threaded directly into a spud 13 that is welded to the outer surface of tank 1. As shown in FIG. 3, the inner diameter of spud 10 is greater than the diameter of edge 3 that borders the opening in tank 1.

The gap between anode 5 and edge 3 is sealed by a resilient grommet type seal 14 having a central waist section 15 of reduced diameter and enlarged upper and lower sections 16 and 17. Waist 15 seals the annular gap between the outer surface of anode 15 and edge 3, while upper section 16 projects laterally outward from edge 3 into engagement with the inner annular surface of spud 13 and lower section 17 extends laterally outward from edge 3 along the glass coating 4.

The lower end of seal 14 is tapered as indicated by 17*a* which aids in inserting the seal into opening 3 from the exterior of the tank prior to installing the anode 5.

As in the case of the first embodiment, seal 14 affectively seals all of the exposed steel areas at the anode mounting area to prevent increased consumption of the anode adjacent tank head 1.

Figure 4:
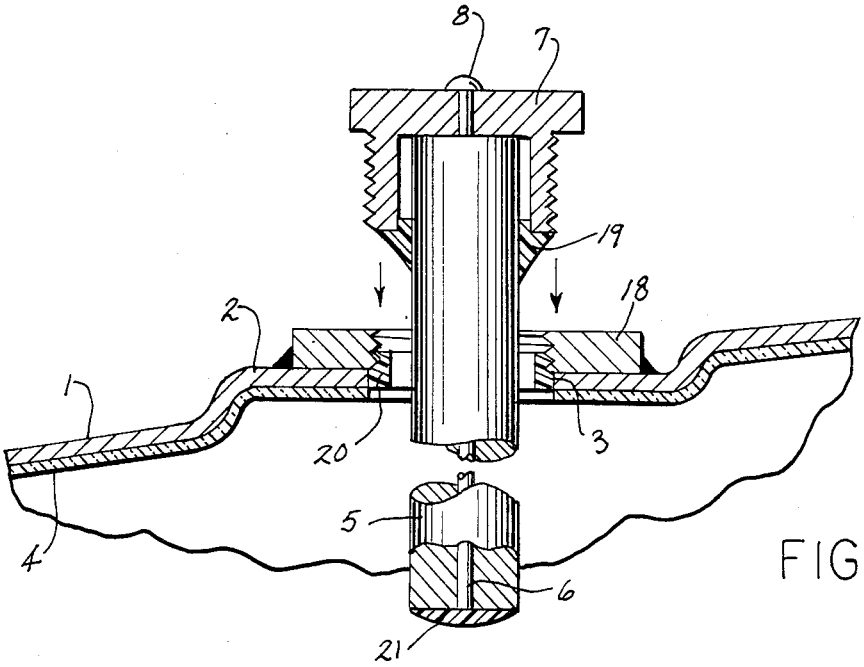
FIG. 4 is an exploded view of a second modified form of the invention.

FIG. 4 shows a further modified form of the invention in which a spud 18 is welded to the outer surface of tank 1 and the inner diameter of spud 18 is approximately equal to the diameter of annular edge 3 in head 1.

To seal the exposed steel areas at edge 3, as well as the inner annular edge of spud 18, a layer of hot melt thermoplastic resin 19 is applied to the lower edge of cap 7 and a second layer of hot melt resin is applied to the internal threads of spud 18 as shown by 20 in FIG. 4. When cap 7 is threaded into spud 18, the resin layers 19 and 20 will affectively seal the gap between edge 3 and anode 5 as well as sealing off any exposed areas of the steel spud 18.

Additionally, a layer of the resin 21 can be applied to the lower end of anode rod 5 to seal off the end of steel core wire 6. Layer 21 will prevent the increased consumption of the lower end anode 5 which can occur if the end of core wire 6 is exposed.

Through use of the anode mounting construction of the invention, all exposed steel areas at the location of the anode mounting are sealed to thereby prevent increased consumption of the upper end of the anode and resulting necking of the anode adjacent the tank head.

In normal water heater construction, the anode is assembled to the tank after the tank is completely fabricated, and the seals 10 and 14, as well as the sealing layers 19 and 20, can be readily installed from outside the tank as the anode is assembled with the tank.

While the drawings show the anode 5 supported from the upper tank head 1, it is contemplated that in other installations the anode may be supported from the cylindrical shell of the tank or from the lower head.

Various modes of carrying out the invention are contemplated as being within the scope of the following claims particularly pointing out and distinctly claiming the subject matter which is regarded as the invention.

We claim:

1. In combination, a steel tank to contain a corrosive fluid and having an opening therein bordered by an annular edge, a corrosion resistant coating disposed on the inner surface of said tank, an anode formed of a metal electro-positive to steel and extending through said opening and spaced inwardly of said edge, a cap secured to the outer end of the anode and located outside of said tank, an annular steel spud welded to the outer surface of said tank and disposed to support said cap, the inner end of said cap being spaced outside of said annular edge, and resilient sealing means disposed within the space between the outer peripheral surface of said anode and said edge and engaged with said edge and with said anode and with said spud to thereby seal said edge and the inner surface of said spud against comunication with said corrosive fluid.

2. The combination of claim 1, wherein said spud is provided with a central bore aligned with said opening, said bore having a greater diameter than said opening.

3. The combination of claim 2, wherein said bore is threaded and said cap has external threads engaged with said threaded bore.

4. The combination of claim 1, wherein said sealing means comprises an annular washer having a first section disposed between the outer peripheral surface of the anode and said edge and having a second section extending laterally outward from said first section along the outer surface of said tank and disposed in engagement with the inner surface of said spud.

5. The combination of claim 1, wherein said corosion resistant coating is a glass coating.

6. The combination of claim 1, and including a steel core wire disposed centrally of said anode and connected to said cap.

7. In combination, a water heater tank having a steel wall and having an opening therein bordered by an annular edge, a glass coating disposed on the inner surface of said wall with said edge being substantially free of said coating, an anode rod formed of a metal electropositive to steel and extending through said opening with the peripheral surface of said road spaced a substantial distance inwardly fkrom sdaid edge to provide an annular space therebetween, a cap secured to the outer end of said anode rod and located outwardly of said wall, a spud secured to the outer surface of said wall and having an internal threaded bore disposed in alignment with said opening, said cap being threaded in said bore, the inner end of said cap being spaced outside of said annular edge, the diameter of said bore being greater than the diameter of said opening, and an annular resilient sealing member sealed against both said edge and said anode rod and sealed against the internal surface of said spud, said sealing member including a first section disposed within said space and a second section extending radially outward from said first section along the outer surface of said wall and disposed in engagement with the inner surface of said spud.

8. The combination of claim 7, wherein said sealing member also includes third section extending radially outward from said first section along the inner surface of said glass coating,

9. The combination of claim 1, wherein said resilient sealing means is a hot melt thermoplastic resin.

10. The combination of claim 7, wherein said spud is steel and is welded to the outer surface of said wall.

11. The combination of claim 8, wherein the inner end of said sealing member is tapered inwardly.

12. In combination, a steel water heater tank to contain heated water and including an upper head, said head having an opening bordered by an annular edge, a corrosion resistant coating disposed on the inner surface of said head, a anode rod formed of a metal electropositive to steel and extending through said opening with the peripheral surface of said anode rod spaced a substantial distance inwardly from said edge to provide an annular space therebetween, a metal cap secured to the outer end of the anode rod and located outwardly of said head, a metal spud secured to the outer surface of said head and disposed to support said cap, the inner end of said cap being disposed axially outside of said annular edge, and an annular resilient sealing member disposed within said annular space and sealed against both said edge and said anode rod and sealed against the internal surface of said spud, said annular sealing member having an inner end terminating adjacent said corrosion resistant coating.

* * * * *